US006052847A

United States Patent [19]

Allyn et al.

[11] Patent Number: 6,052,847

[45] Date of Patent: Apr. 25, 2000

[54] MATTRESS WITH A CONCAVITY FOR THE BREASTS

[75] Inventors: Timothy James Allyn; Nicholas George Sarantes, both of Los Angeles, Calif.

[73] Assignee: DGF Outdoors, Los Angeles, Calif.

[21] Appl. No.: 09/069,460

[22] Filed: Apr. 28, 1998

[51] Int. Cl.[7] ..... A47C 20/00

[52] U.S. Cl. ..... 5/632; 5/634; 5/735

[58] Field of Search ..... 5/632, 633, 634, 5/731, 733, 735, DIG. 900.5

[56] References Cited

U.S. PATENT DOCUMENTS

| | | | |
|---|---|---|---|
| 1,548,728 | 8/1925 | Milam | 5/735 X |
| 2,182,861 | 12/1939 | Albert | 5/735 X |
| 4,518,203 | 5/1985 | White | 297/456 |
| 4,960,304 | 10/1990 | Frantz | 297/284 |

FOREIGN PATENT DOCUMENTS

| | | | |
|---|---|---|---|
| 452283 | 11/1927 | Germany | 5/632 |

*Primary Examiner*—Terry Lee Melius
*Assistant Examiner*—James M Hewitt
*Attorney, Agent, or Firm*—Miller Nash LLP

[57] ABSTRACT

A mattress having a wedge-shaped mattress body with an inclined upper surface, the upper surface divided by a transverse breast concavity into a head-supporting portion and a body-supporting portion. The mattress has a flat position in which the concavity is open to receive breasts as well as an upright position in which the concavity functions as a hinging mechanism and the mattress is held in the upright position by adjustable mechanisms. In the flat position the mattress may be used in the prone position, laying on the back, or in a yoga position. In the upright position, the mattress may be used laying on the back and partially sitting upright, or, by adjusting the position of the mattress, sitting upright.

17 Claims, 7 Drawing Sheets

MATTRESS WITH A CONCAVITY FOR THE BREASTS

BACKGROUND OF THE INVENTION

The present invention relates to a mattress and particularly to a mattress with a concavity for the breasts that makes laying in a prone position more comfortable.

Although many people prefer to lay on their stomachs in a prone position, this position can be uncomfortable on the ground, on a standard or firm mattress, or on a lounge chair. Females, in particular, find the prone position uncomfortable due to pressure on their breasts.

The prone position can also be uncomfortable because arms have to either be folded under the head, be resting along side the body, or be in some combination of under the head and along side the body. With arms under the head, shoulders are strained and circulation to the arms is restricted. Arms along side of the body relieves the strain on the shoulders, but does not necessarily comfortably stabilize the body and puts strain on the neck.

Attempting to read or perform other activities that require the head to be supported while in a prone position can also be uncomfortable. In this position, the weight of the head, neck, and upper torso falls on the elbows and wrists as the head (chin) rests in the hands while the forearms are supported by the elbows. This strains the neck and causes stress in the shoulders.

Further, if the abdomen is not supported while the body is in a prone position, an excessive downward swaying of the spinal column results. Long periods of time spent in this swayed position can cause lower back pain. This swayed position is particularly prevalent when a pregnancy pillow is used by a non-pregnant user.

Finally, even for those people who favor laying in the prone position, laying on one's back or partially sitting up are alternative positions that are used occasionally. These alternative positions require support.

There are known mattresses, pads, and pillows that address some of the issues set forth above, but none address all of the issues. Several known mattresses are directed primarily to the problems suffered by pregnant women with large abdomens, but these pregnancy mattresses also fail to address all of the problems set forth above.

Several devices have been developed directed to solving the problems associated with pressure asserted on a woman's breasts when laying in the prone position. Several of these references suggest the use of a concavity in which the breasts hang freely. For example, U.S. Pat. No. 2,182,861 to Albert discloses a treatment pad with an open space transversely across the pad suitable for a woman's breasts. This reference, because it was designed for use by chiropractors, masseurs, and physicians, was only meant to be used while lying flat. This is particularly evidenced by the straps which are specifically used for securing the pad to the table. There is no teaching or suggestion to use the Albert pad while sitting partially upright.

U.S. Pat. No. 1,548,728 to Milam suggests a mattress with a removable section for the breasts. Milam also suggests an adjustable hinged headrest that, as shown, can be raised or lowered from below the headrest. The structure used to support the headrest in the raised position, however, might not be able to support a user in a partially upright position. Also, since the Milam mattress is flat, not wedge shaped, it would not provide advantages of the wedge shape such as lower back support and a gentle incline.

BRIEF SUMMARY OF THE INVENTION

The mattress of the present invention includes a concavity that allows a woman to lay in the prone position without enduring the discomfort of pressure on her breasts. More specifically, the mattress of the present invention is a wedge-shaped mattress body having an inclined upper surface. The upper surface divided by a transverse breast concavity into a head-supporting portion and a body-supporting portion.

The mattress of the present invention preferably has a natural flat position in which the concavity is open to receive breasts as well as an upright position in which the concavity functions as a hinging mechanism and the mattress is held in the upright position by adjustable mechanisms. In the flat position the mattress may be used in the prone position, laying on the back, or in a yoga position. In the upright position, the mattress may be used laying on the back and partially sitting upright, or, by adjusting the position of the mattress, sitting upright.

As mentioned above, the concavity in the mattress allows a woman to lay in the prone position without enduring the discomfort of pressure on her breasts. Further, the mattress of the present invention enables the user to read or perform other activities with the head elevated and upright while laying in a prone position which tends to reduce stress and pressure to the shoulders, wrists, elbows, and back. Still further, the mattress of the present invention is preferably narrow enough to allow the arms to hang down and to the side in a comfortable position. The wedge shape of the present invention provides support for the abdomen and pelvis. Finally, the present invention includes an adjustable headrest that allows the user to lay on her back at a gentle incline or with her head elevated.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
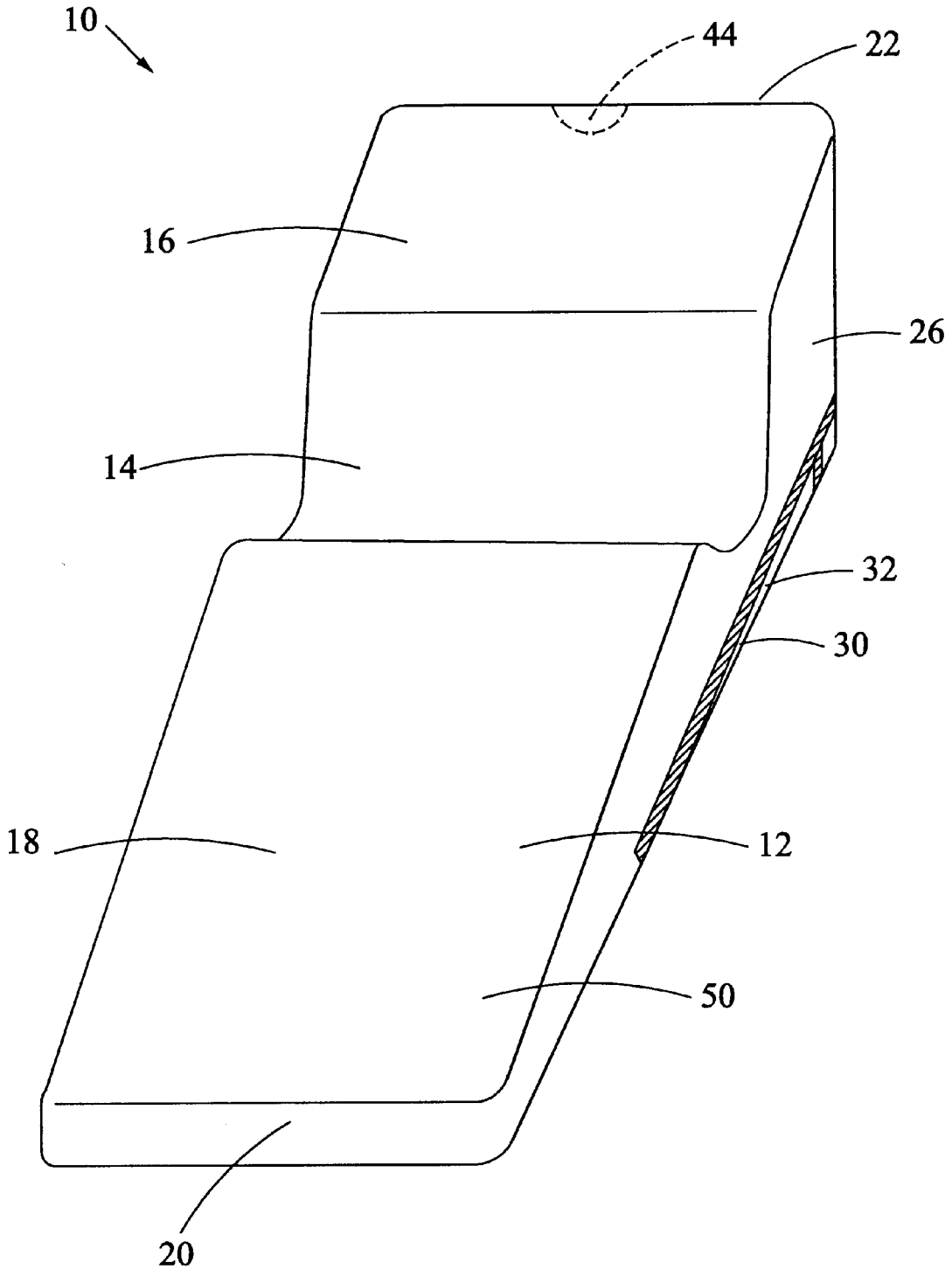
FIG. 1 is a perspective view of a mattress with a concavity of the present invention.
Figure 2:
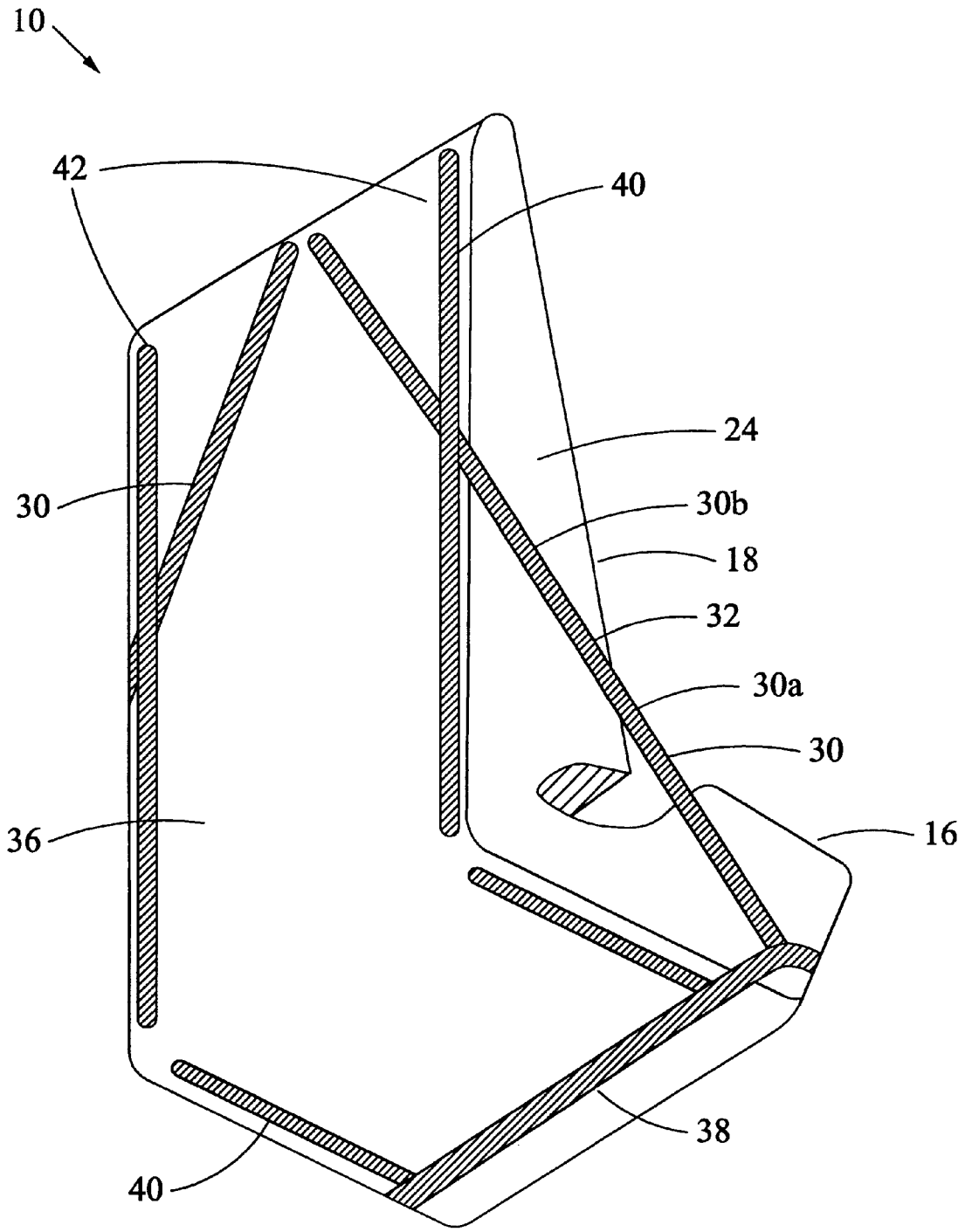
FIG. 2 is a perspective view showing the lower surface and support structure of the mattress of the present invention.

FIGS. 1 and 2 show one embodiment of the mattress 10 of the present invention. Preferably the mattress 10 is a single piece of predominantly wedge-shaped cushioned material. The mattress 10 has an inclined upper surface 12 that is divided by a transverse breast concavity 14 into a head-supporting portion or headrest 16 and a body-supporting portion 18. Preferably, the mattress 10 is narrow enough to allow the arms to hang down and to the side in a comfortable position.

The body-supporting portion 18 extends between the lower edge 20 and the breast concavity 14. The headrest 16 extends between the breast concavity 14 and the higher edge 22. Generally the lower edge 20 of the mattress 10 is at the lowest elevation of the upper surface 12. From the lower edge 20, the upper surface 12 ascends to the opposite edge or higher edge 22 that is generally the highest elevation of the upper surface 12. The breast concavity 14, headrest 16, and body-supporting portion 18 have side borders that extend between the first mattress side 24 and the second mattress side 26 of the mattress 10.

Figure 3A:
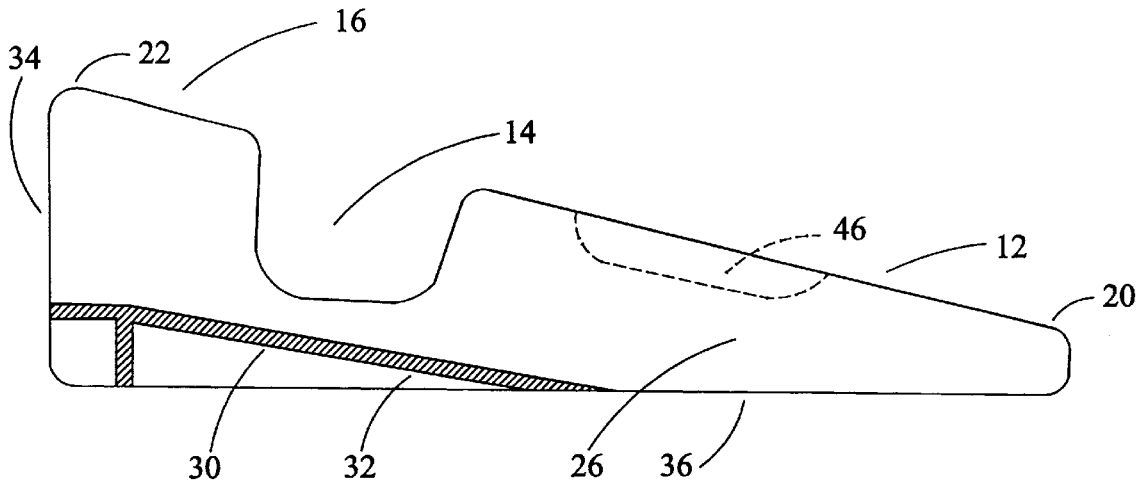
FIG. 3A is a side view of the mattress of the present invention with the adjustable headrest in a flat position.
Figure 3B:
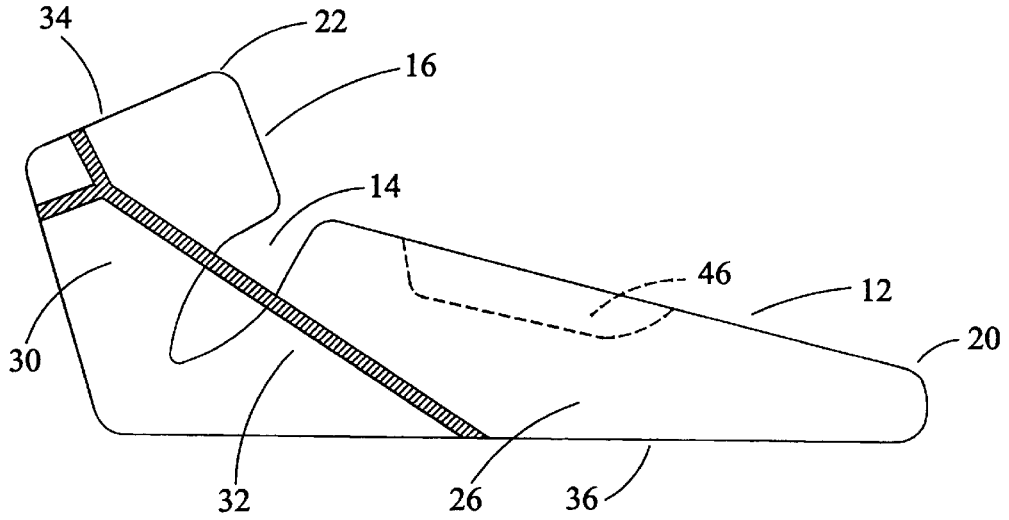
FIG. 3B is a side view of the mattress of the present invention with the adjustable headrest in an upright position.
Figure 4A:
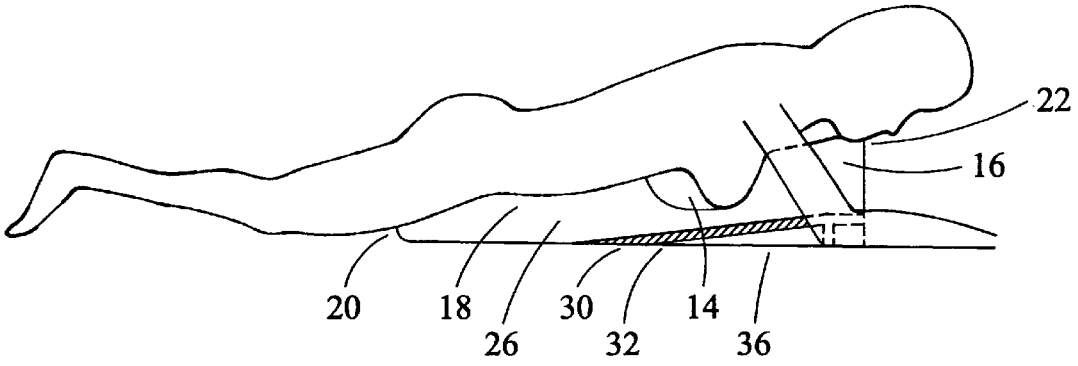
FIG. 4A is a side view of the mattress in the flat position being used in the prone position, the user's head being in an upright position supported by the chin.
Figure 4B:
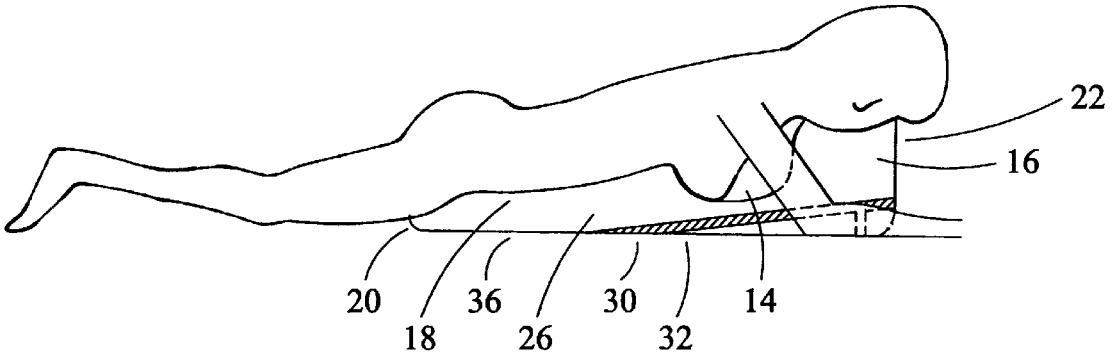
FIG. 4B is a side view of the mattress in the flat position being used in the prone position, the user's head resting on the side.
Figure 5A:
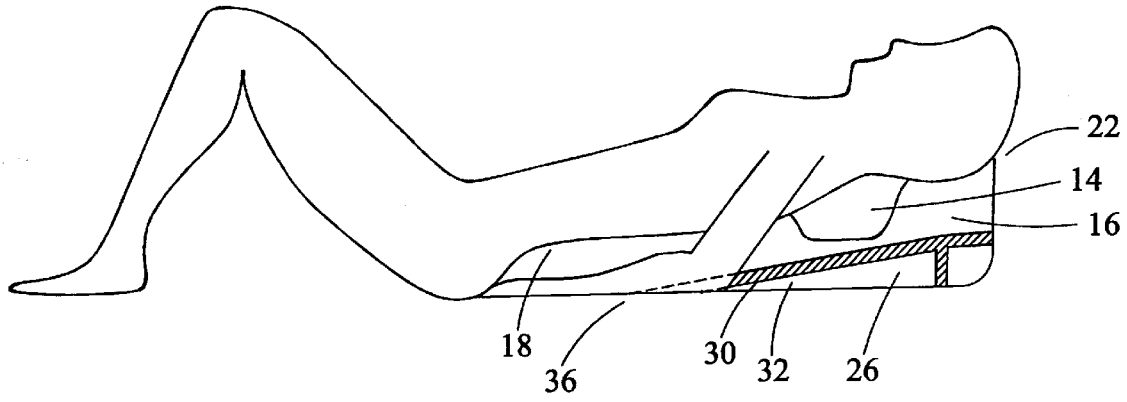
FIG. 5A is a side view of the mattress in the flat position being used laying on the back.
Figure 5B:
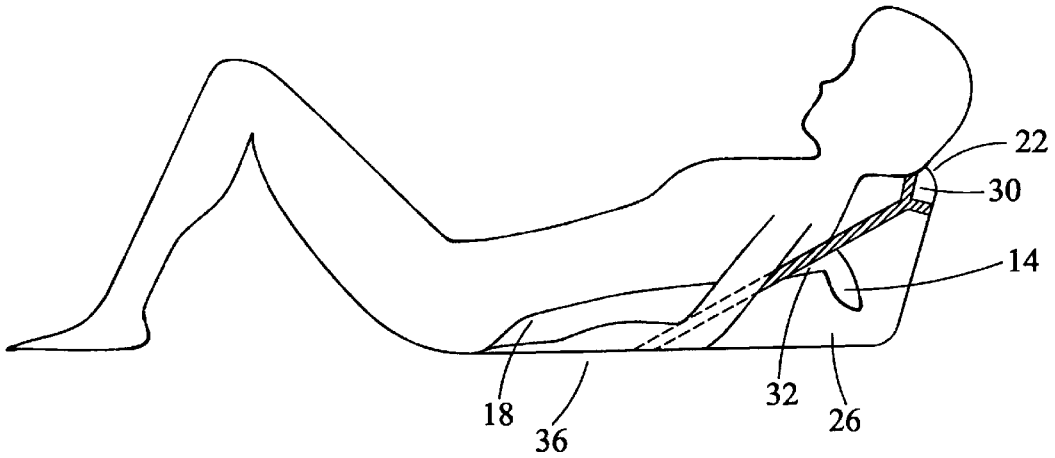
FIG. 5B is a side view of the mattress in the upright position being used laying on the back with head elevated.

The mattress 10 of the present invention is adjustable between a flat position (FIGS. 1, 3A, 4A, 4B, and 5A) and an upright position (FIGS. 3B and 5B). The mattress 10 is also adjustable to intermediate positions between the flat and upright positions. In the shown embodiment the flat position is the natural position of the mattress 10 and the mattress 10 is held in the upright position by adjustable mechanisms such as straps 30 and buckles 32. In the upright position the breast concavity 14 functions as a transverse crease or bending line between the headrest 16 and the body-supporting portion 18.

As set forth above, the adjustable headrest 16 can achieve variety of positions using mechanical adjustable mechanisms to hold the adjustable headrest 16 in the desired position. Using the mechanical adjustable mechanisms, the adjustable headrest 16 can be raised and lowered between the flat and upright positions.

The shown adjustable mechanisms include identical sets of straps 30 on both sides 24, 26 of the mattress 10. As shown in FIG. 3B, each set of straps 30 includes a headrest strap 30*a* attached to the headrest 16 and a body-supporting strap 30*b* attached to the body-supporting portion 18. As shown, headrest strap 30*a* is attached along a side 24, 26 to the back surface 34 and the under surface 36 of the mattress 10. As also shown in FIG. 3B, the body-supporting strap 30*b* is attached along a side 24, 26 to the under surface 36 between the lower edge 20 and the concavity 14. An adjustable buckle 32 may be used to adjustably interconnect the headrest and body-supporting straps 30*a*, 30*b*. Alternative mechanical adjustable mechanisms such as velcro, knots, buttons, and hooks may also be used.

The mattress 10 of the present invention has several significant advantages over known art. Particularly, the simplicity of the wedge-shaped piece with the single transverse concavity 14 is simple to produce, and yet quite effective. The mattress 10 of the present invention uses the single concavity 14 to perform the functions that, in the Milam mattress, require both a removable breast section and a hingedly attached headrest. Further, the adjustable mechanisms 30, 32 of the present invention are inexpensive and yet provide greater support than the structure placed under the Milam headrest. In fact, if a large person uses the mattress 10 of the present invention, the greater weight on the body-supporting portion 18 provides proportionately greater support for the headrest 16 so that it is able to support a user partially sitting up.

Optionally, the mattress 10 may include support structure 40 such as reinforcement bars 42 may be used to provide added support to the under surface 36. The support structure 40 on the under surface 36 of the headrest 16 provides added support when the mattress 10 is in the upright position. Alternative support structure 40 such as wire mesh, sheets of metal, wood, and stiff plastics may be used in place of the reinforcement bars 42 and may have different configurations.

FIG. 4A shows the mattress 10 in the flat position being used in the prone position. In this position the user's breasts are placed in the breast concavity 14 and her chin rests on the headrest 16 near the higher edge 22. An optional chin rest 44 (as shown in phantom FIG. 1) may be included in which a user's chin rests. The user's arms may hang naturally either forward beyond the head (as shown) or backward alongside the body. In this position the user's head is supported in an upright position with the chin supported on the chin rest area of the headrest 16. One advantage of this position include that it permits the female to lay in a prone position alleviating discomfort to the breasts as they hang in the concavity 14. Another advantage of this position is that it permits the user to lay in a prone position with the head upright to read without straining the neck, shoulders, arms, and wrists.

FIG. 4B shows the mattress 10 in the flat position being used in an alternate prone position. Like the position shown in FIG. 4A, the user's breasts are placed in the breast concavity 14, however her face or cheek rests on the headrest 16. The user's arms may hang naturally either forward beyond the head (as shown) or backward alongside the body. One advantage of this position include that it permits the female to lay in a prone position alleviating discomfort to the breasts as they hang in the concavity 14.

FIG. 5A shows the mattress 10 in the flat position being used laying on the back at a gentle incline. The arms can fold over the body (not shown) or hang down along the side. The lower back is positioned on the body-supporting portion 18. In this position the user may lay with her knees up or down. Further, in this position her lower back firmly supported.

FIG. 5B shows the mattress 10 in the upright position being used laying on the back partially sitting up (which also can be described as laying inclined with head raised and supported by the adjustable headrest). The user's arms can fold over the body (not shown) or hang down along the side. The user's lower back is positioned on the body-supporting portion 18. In this position the user's lower back firmly supported.

Figure 6:
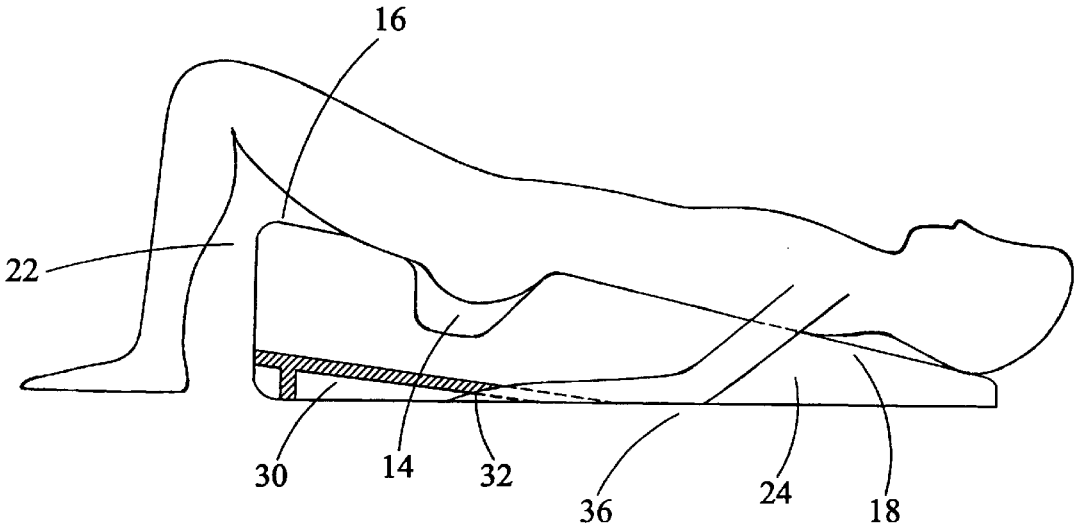
FIG. 6 is a side view of the mattress in the flat position being used in a yoga position.

FIG. 6 shows the mattress 10 in the flat position being used in a "yoga" position. This position reverses the position of the user in relation to the mattress. Specifically, the user's head is near the lower edge 20 and the user's feet are near the higher edge 22. In this yoga position the user's posterior rests in the concavity 14.

Figure 7:
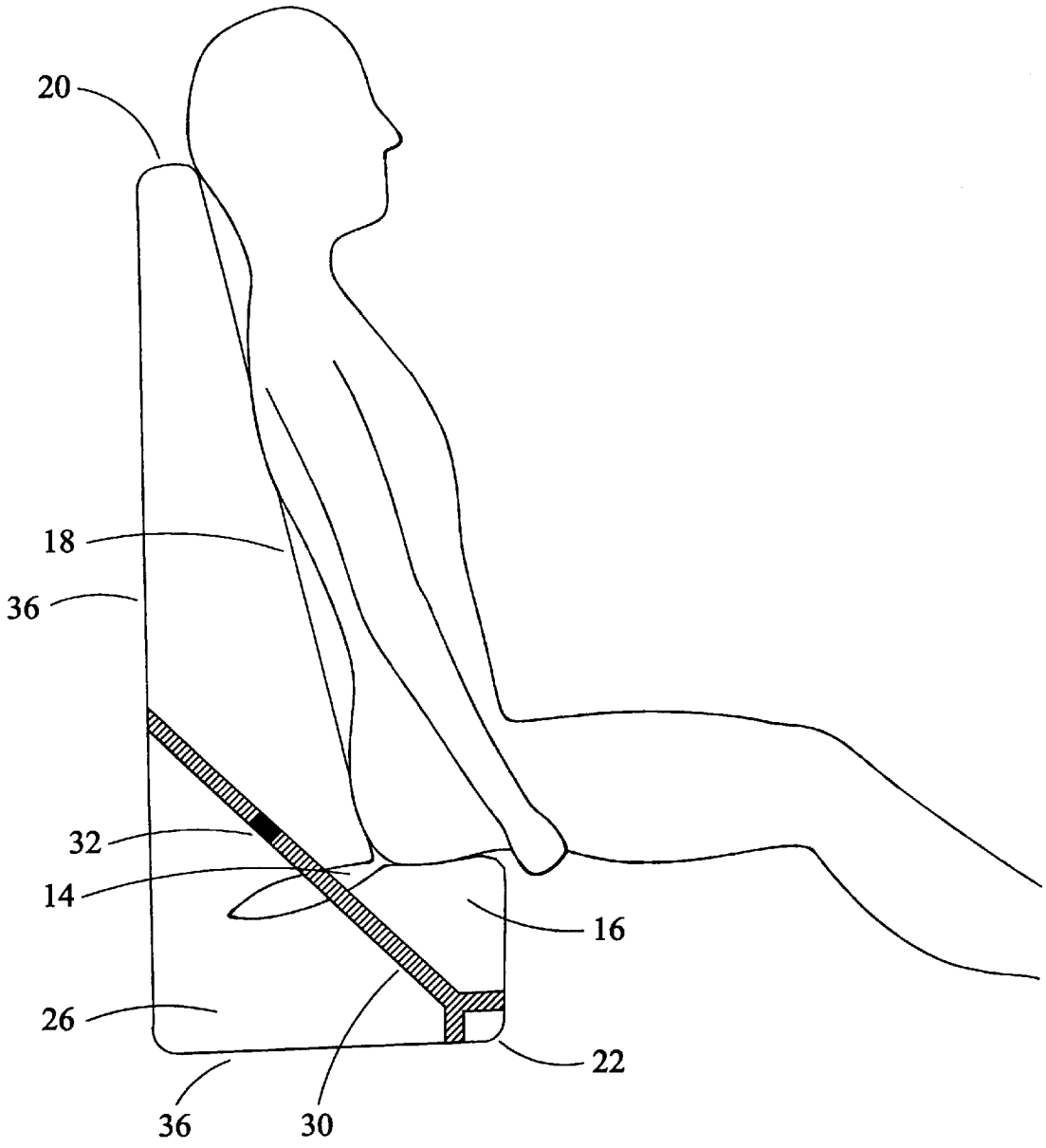
FIG. 7 is a side view of the mattress in the upright position being used in a seated position.

FIG. 7 shows the mattress 10 in the upright position being used in a seated position. In this position the user's posterior is supported by the headrest 16 and the user's back is supported by the upright body-supporting portion 18.

Alternate embodiments of the mattress 10 can have a variety of shapes including but not limited to: an hourglass; a wedge that varies in slope or becomes flat throughout a defined section such as from the breast concavity to the adjustable headrest 16; a wedge that is longer or shorter in length and/or wider or narrower in width; a wedge that has larger or smaller features such as those features described and shown within this application. The breast concavity 14 may be an oval basin on the upper surface 12 as shown or may have a any alternative shape (such as a half circle) that would accommodate a woman's breasts. The body-supporting portion may include an optional removable/replaceable abdomen concavity 46 (shown in phantom) adapted to accommodate the abdomen of a pregnant woman. The present invention may also include a carrying handle (not shown) to enable easy transportation of the mattress 10.

The mattress 10 is preferably constructed of any pliable material available offering the same characteristics of an open cell, high density polyurethane. Additionally, the mattress form can be achieved by creating a skin that incorporates the usage of air (blow-up), water, jells, foams and any other material that can be used in conjunction with a skin. An alternative embodiment is constructed from non-cushioned material but still provides the advantages associated with a breast concavity, as discussed above. The mattress 10 may be covered with a durable form fitting fabric cover 50 that may be water repellant, waterproof, and/or water absorbent depending on the intended use of the mattress 10. Still further, although the preferred embodiment uses a unitary mattress body, such a unitary mattress body may be constructed of a separate headrest and a separate body-supporting portion that are permanently joined or connectable to each other. The mattress 10, regardless of the materials used in production, will offer the benefits provided by the basic design of said invention.

Finally, it should be noted that although much of the above set forth text is related to the use of the mattress 10 by a woman, the mattress may be used by a man, child, or woman with small breasts.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A mattress comprising:

(a) a wedge-shaped mattress body having an inclined upper surface and a lower surface;

(b) said upper surface divided by a transverse breast concavity into a head-supporting portion and a body-supporting portion;

(c) said lower surface having supporting reinforcement bars thereon;

(d) said mattress having a natural flat position in which said breast concavity is open to receive breasts;

(e) at least one support mechanism for independently supporting said mattress in an upright position in which said breast concavity is a hinging mechanism, said head-supporting portion being pulled toward said body-supporting portion in said upright position; and (f) said mattress being selectively positionable in said natural flat position and said upright position.

2. The mattress of claim 1 further comprising:

(a) said upper surface having a lower edge and an upper edge;

(b) said body-supporting portion extending between said lower edge and the breast concavity;

(c) said head-supporting portion extending between the breast concavity and said upper edge.

3. The mattress of claim 1 wherein said at least one support mechanism is adjustable.

4. The mattress of claim 1 further comprising:

(a) a first set of straps on a first side and a second set of straps on a second side;

(b) said first set of straps including a head-supporting strap attached to said head-supporting portion and a body-supporting strap attached to said body-supporting portion; and (c) said second set of straps including a head-supporting strap attached to said head-supporting portion and a body-supporting strap attached to said body-supporting portion.

5. The mattress of claim 4 wherein said head-supporting strap and body-supporting strap of said first set of straps are attached by a first adjustable mechanism and said head-supporting strap and body-supporting strap of said second set of straps are attached by a second adjustable mechanism.

6. The mattress of claim 5 wherein said first and second adjustable mechanisms are buckles.

7. The mattress of claim 1 wherein said mattress body is open cell high density polyurethane.

8. The mattress of claim 1 wherein said mattress body is covered with a durable form fitting fabric cover.

9. The mattress of claim 1 wherein said body-supporting portion has an abdomen cavity defined therein.

10. A mattress having a head-supporting portion and a body-supporting portion separated by a concavity, said mattress comprising:

(a) said mattress having a natural flat position in which said concavity is open to receive breasts;

(b) said mattress having an upright position in which said concavity is a hinging mechanism, said head-supporting portion being raised when said mattress is in said upright position, said mattress being independently held in said upright position by at least one adjustable mechanism; and (c) said mattress having a lower surface with supporting reinforcement bars thereon.

11. The mattress of claim 10 wherein said adjustable mechanisms are straps and buckles.

12. The mattress of claim 10 wherein said mattress in said flat position may be used in the prone position or laying on the back.

13. The mattress of claim 10 wherein said mattress in said upright position may be used laying on the back and partially sitting upright.

14. The mattress of claim 10 wherein said mattress in said flat position may be used laying on the back in a yoga position.

15. The mattress of claim 10 wherein said mattress in said upright position may be used in a seated position.

16. The mattress of claim 10 wherein said body-supporting portion has an abdomen cavity defined therein.

17. The mattress of claim 10, said mattress having a lower surface, a first part of said at least one adjustable mechanism being attached to said lower surface of said head-supporting portion and a second part of said at least one adjustable mechanism being attached to said lower surface of said body-supporting portion.

* * * * *